US005369236A

United States Patent [19]

Nickels, Jr.

[11] Patent Number: 5,369,236

[45] Date of Patent: Nov. 29, 1994

[54] CONTROL SWITCH ARRANGEMENT FOR ORBITAL POLISHER

[75] Inventor: Richard C. Nickels, Jr., Hampstead, Md.

[73] Assignee: Black & Decker Inc., Newark, Del.

[21] Appl. No.: 954,814

[22] Filed: Oct. 1, 1992

[51] Int. Cl.[5] ..... H01H 3/00

[52] U.S. Cl. ..... 200/329; 200/330; 200/331

[58] Field of Search ..... 200/329, 330, 331, 332, 200/335, 337, 42.01, 519, 332.3, 338, 333, 518; 15/97.1, 49.1, DIG. 10, 50.1

[56] References Cited

U.S. PATENT DOCUMENTS

| | | | |
|---|---|---|---|
| 2,348,268 | 5/1944 | Smith | 15/49 |
| 2,552,471 | 5/1951 | Watkins | 15/93 |
| 2,701,288 | 2/1955 | Russell et al. | 200/172 |
| 3,412,415 | 11/1968 | Brab | 15/50 |
| 3,854,020 | 12/1974 | Glover et al. | 200/321 |
| 4,174,473 | 11/1979 | Brenneman | 200/332.2 |
| 4,188,682 | 2/1980 | Burglin et al. | 15/97 R |
| 4,198,721 | 4/1980 | Copeland | 15/50.3 |
| 4,435,870 | 3/1984 | Tucker et al. | 15/98 |
| 4,542,551 | 9/1985 | Phillips | 15/49 R |
| 4,756,042 | 7/1988 | Genovese et al. | 15/98 |
| 4,857,681 | 8/1989 | Rush, Jr. et al. | 200/61.85 |
| 4,879,438 | 11/1989 | Winchester | 200/61.85 |
| 4,900,881 | 2/1990 | Fischer | 15/49.1 |

FOREIGN PATENT DOCUMENTS

| | | |
|---|---|---|
| 850813 | 10/1960 | United Kingdom . |
| 1461274 | 5/1974 | United Kingdom . |
| WO8404851 | 12/1984 | WIPO . |

*Primary Examiner*—Henry J. Recla
*Assistant Examiner*—David J. Walczak
*Attorney, Agent, or Firm*—Harness, Dickey & Pierce

[57] ABSTRACT

A hand-held orbital polisher includes a housing, an electric motor and hand-operated motor control device mounted in the housing, and a pair of handles closely coupled to a housing to position an operator's thumbs adjacent the control device. The control device includes an electrical switch having a slidable actuator and a pair of thumb-actuated levers to selectively move the actuator into either of two on positions or into an off position. The levers are pivotably mounted to the housing, have a collar drivingly connected to the actuator, and a thumb pad at one end. The pivots can be defined at the other end of the levers and the collar at the center, or at the center of the lever and the collar at the other end of the lever. One or both of the user's thumbs can be used to apply a force with a force on one lever being transmitted simultaneously to the actuator and thereby against the other beam whereby to force the two levers in one or the other position, the operator's hand never having to leave the handles.

22 Claims, 5 Drawing Sheets 5
96
82
94
88
52a
92
90a
90
80
91b
91
93
89
54a
95
84
4
48
58
46
79
78
60
50
36

82
96
94
88
52b
70
76
56b
62
72
74
68
54b
89
96
95
84
52a
52
56a
58
48
36
92
91a
80
91
93
56
91b
56a
54
54a
60
50

CONTROL SWITCH ARRANGEMENT FOR ORBITAL POLISHER

BACKGROUND OF THE INVENTION

The present invention relates to a hand-held apparatus having a housing for mounting a drive motor and a control therefor and more particularly to an improved control switch and housing mounting arrangement that enhances the ability of the operator to actuate different functions of the apparatus without removing his hands from gripping relation with the apparatus. For the purposes of convenience the apparatus will be referred to as a hand-held orbital polisher.

For a number of years, the U.S. Product Safety Commission has required that certain new electrical power equipment be provided with an actuator of the type which will automatically stop the operation of a tool when an operator releases the actuator. Actuators of this type help prevent accidental injury to the operator as it makes it difficult for the operator to approach the moving parts of the tool while the tool is still actuated. Oftentimes, the tool may be of the type which requires the operator to perform two separate or distinct functions to actuate the tool. Such an actuation also makes it more difficult to operate the tool.

There are numerous designs for such actuators presently being incorporated into new power tools. While most operate satisfactorily for their intended purpose, many suffer from the disadvantages that they are difficult for the operator to actuate, they are physically taxing to maintain in the actuated position, and they are relatively complicated in construction and thus are difficult and expensive to manufacture.

SUMMARY OF THE INVENTION

It is therefore an object of the present invention to provide a power tool having a housing and motor actuator arranged for a hand held use by the operator.

Another object of this invention is provision of an electrical control device for a power tool which is relatively easy to manipulate and which minimizes fatigue of the operator during prolonged actuation.

Yet another object of the invention is to provide an electrical control for a power tool which is of a simple construction and therefore quite easy to manufacture.

A further object of this invention is provision of a multi-function actuator for an electrical tool which is convenient to use for both left-handed and right-handed operators.

It is a further object of the invention to provide an multi-function electrical control device for a hand held power tool, which device has a stable "off" position, and two "on" positions to provide essentially immediate action to actuate the tool.

According to the present invention, there is provided a multi-function electrical control device for an electrically powered tool, such as a hand-held polisher, which tool comprises a housing having a pair of handles closely connected thereto, and an electrical switch and a pair of actuating levers therefor mounted in the housing. The switch includes a projecting actuator having opposite first and second sides and movable from an inoperative first position into an operative second position for providing either a first or second function, detents for releasably retaining the actuator in the inoperative first position and in a first of the operative second positions, and a bias member for normally biasing the actuator from the second of the operative second positions to the inoperative first position.

The levers are mounted to pivot around a respective axis within said housing whereby to move the actuator between its positions. The levers have a first end portion in the form of a manually squeezable thumb actuated pad which extends away from its respective pivot axis and a collar portion which is connected to the actuator and movable against each of the sides of the actuator. The lever interconnection is such that application of force against one or both of the pads in either of opposite first or second directions from the inoperative first position causes the actuator to move from the first position to the second position. The first function in the first of the operative second positions represents a "momentary on" position wherein the tool is actuated when the operator forces the actuator in the first direction and into the second position and is automatically deactivated when the operator releases his grip on the actuating levers. The second function in the second of the second positions is a "stable on" position wherein the tool remains activated after the operator has pushed the control device in the second direction, opposite to the first direction, and into the second position. The tool can be deactivated only by the operator pushing the actuator in the first direction to the inoperative first position.

Further objects, advantages and features of the present invention will become more fully apparent from the detailed consideration of the arrangement and construction of the constituent parts as set forth in the following description taken together with the accompanying drawings.

DETAILED DESCRIPTION OF THE PREFERRED EMBODIMENT

Figure 1:
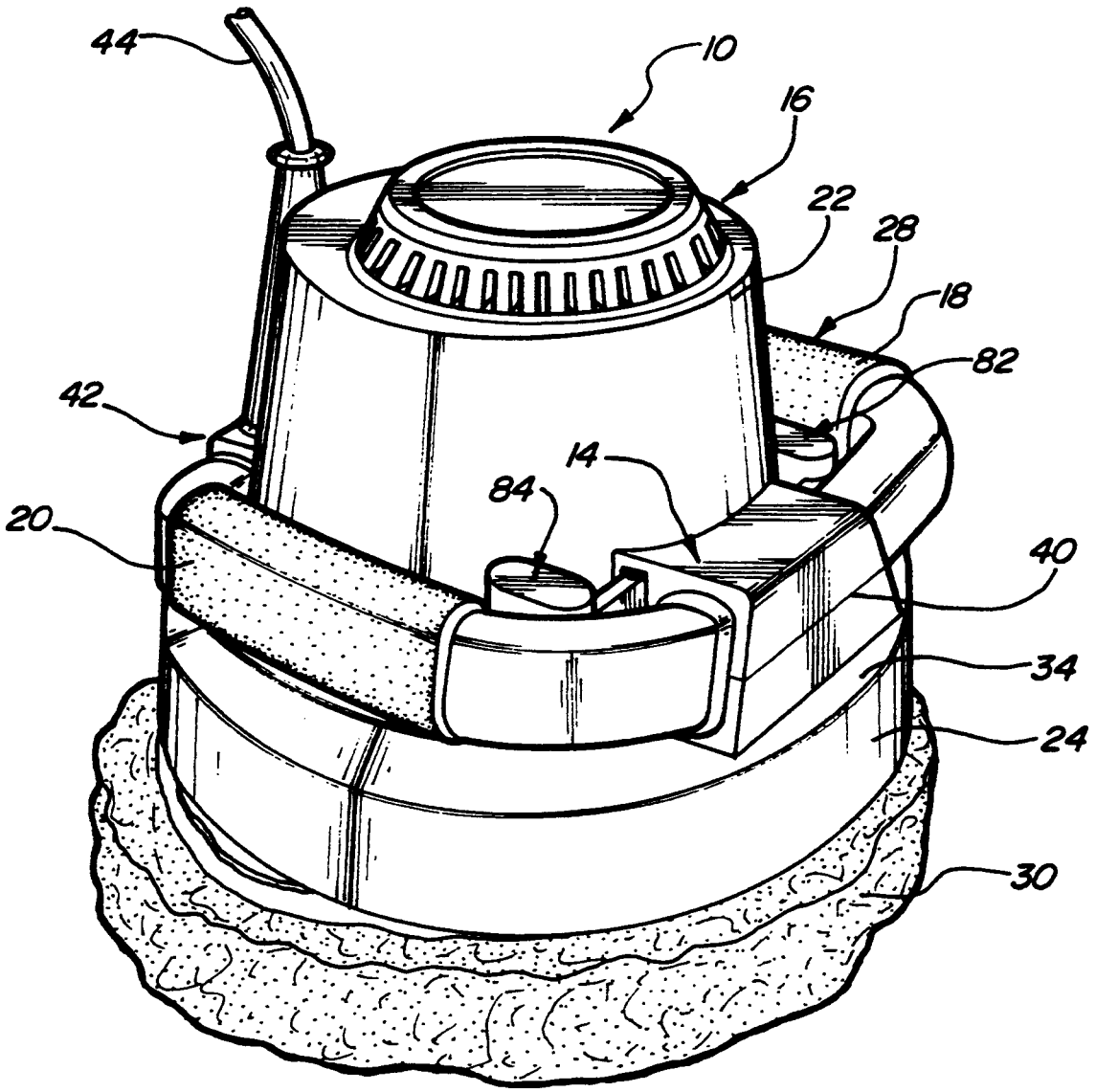
FIG. 1 is a perspective view of an orbital polisher having a three-position electrical control device according to the present invention.
Figure 2:
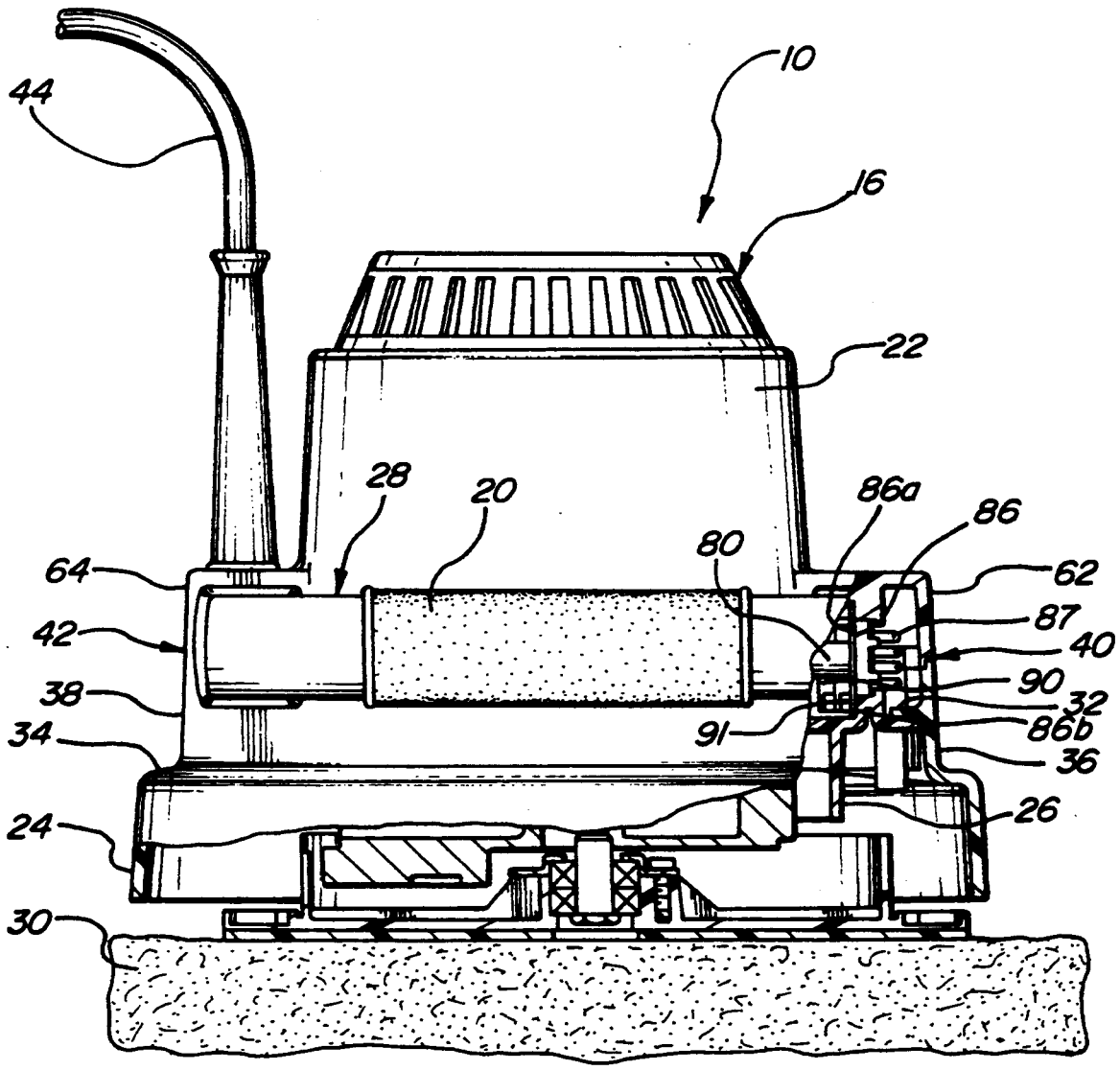
FIG. 2 is an elevation view of the orbital polisher, partially in section, and showing a portion of the control device and housing therefor.

FIGS. 1–7 illustrate exemplary preferred embodiments an improved control switch and mounting arrangement for a hand-held polisher that enhances the ability of left and right-handed operators to actuate different functions of the polisher without removing his hands from gripping relation with the apparatus. It is to be understood that FIGS. 1–7 are exemplary and that the invention is applicable to other apparatus which is held by and actuated by the hands of the user while holding the apparatus.

Turning now the drawings, FIGS. 1-7 illustrate a hand-held orbital polisher 10 of the type having an electrical motor (not shown) to drive a surface treatment assembly (e.g., a polishing pad), a control device 14 in operable relation to the motor, a housing assembly 16 for mounting the motor and control device, and a pair of handles 18 and 20 close 14 connected to the housing. In use, the operator uses both hands to grasp the polisher handles very near to the housing whereby the thumbs of the operator's hands are readily positioned to operate the control device without removing his hands from the polisher handles.

The housing assembly 16 is generally symmetrically disposed about a central vertical axis corresponding to the axis of the motor shaft and includes upper and lower housing sections 22 and 24 of frusto-conical cross-section for enclosing the motor, an interior platen 26 for positioning and mounting the housing sections relative to the motor, and a handle assembly 28 connected to the lower housing section and including the handles 18 and 20. The lower housing section 24 is disposed vertically adjacent to the surface to be polished to form a protective skirt which encircles a polishing pad 30 and define a bottom portion of the unit. The skirt 24 is rigidly secured to the platen 26 and includes an interior flange 32 which abuts an upper face of the platen and an upwardly facing annular shoulder 34.

A pair of U-shaped wall sections 36 and 38 project vertically upwardly from diametrically opposed locations on the shoulder and cooperate to form, respectively, the bottom parts of a first housing 40 at the front of the polisher for enclosing the control device and a second housing 42 at the rear of the polisher for mounting an electrical wire 44 used to supply power to the motor. The wall section 36 includes a front wall 46, and a pair of sidewalls 48 and 50, each sidewall terminating in an upwardly facing edge. A respective notch **52*a* and 54*a* extends vertically inwardly from each edge. Transverse walls 58 and 60 extend, respectively, laterally inwardly from the sidewalls 48 and 50 and vertically upwardly from the shoulder 34. The upwardly facing edge of each wall 58 and 60 is formed to include a notch 56*a* of semicircular shape. The wall section 38 is important as forming the bottom half of the second housing 42** but forms no part of this invention.

The handle assembly 28 includes a pair of generally rectangular cover sections 62 and 64 which are connected to the handles 18 and 20. The cover sections 62 and 64 have respective lower edges generally corresponding to the upper edges of the wall sections 36 and 38 and are abutted thereagainst to form the housings 40 and 42. The cover section 62 comprises a front wall 66, a pair of sidewalls 68 and 70, and a top wall 72, the walls being joined along common edges to form a box-like shape. A notch **52*b* and 54*b* extends vertically inwardly from the respective edges of the sidewalls 68 and 70. Transverse walls 74 and 76 extend, respectively, laterally inwardly from the sidewalls 68 and 70 and vertically downwardly from the top wall 72. The downwardly facing edge of each transverse wall 74 and 76 is formed to include a notch 56b** of semicircular shape.

The cover section 62 is adapted to be joined to the wall section 36 and form the first housing 40 and the cover section 64 is adapted to be joined to the wall section 38 and form the second housing 42. When joined, the notches **52*a*, 54*a* and 56*a* are superposed with the notches 52*b*, 54*b* and 56*b*. The semicircular notches 56*a* and 56*b* cooperate to form in the wall pairs 58, 74 and 60, 76 so combined a cylindrical journal 56 to support a pivot pin. Further, the vertical notches 52*a* and 54*a* register with the notches 52*b* and 54*b* to form a vertical slot 52 and 54** in the sidewall pairs so combined.

The control device 14 includes an electrical switch 78 including a movable actuator 80, and a pair of levers 82 and 84 for manually driving the actuator between a stable "off position" where the motor is inoperative and into either of two "on positions" where the motor is operative, and back to the stable off position. The switch 78 is of the type which includes internal detents (not shown) to releasably retain the actuator both when the actuator is in the stable off position and in a stable on position, and an internal spring element (not shown) to bias the actuator back into the off position when the actuator is in a momentary on position.

The switch 78 is generally rectangular in shape and includes a flange 86 having its opposite ends **86*a* and 86*b* adapted to be received in upper and lower slots provided, respectively, in the cover section 62 and platen, the actuator 80 projecting from one side of the switch enclosure, and an array of terminals 87 projecting from the other side of the switch enclosure. Although not shown, electrical wires 79** would connect the terminals to the motor circuit. The switch is commercially available, such as exemplified by the switch S-2013RC06-U available from the Ark-Les Corporation.

The levers 82 and 84 are intended for use, respectively, by the left and right thumbs of the operator's hands when grasping the handles 18 and 20. The levers are substantially mirror images of one another. The lever 82 is elongated, integrally formed of plastic, and includes a generally flat central body portion 88, a pivot pin 92 projecting perpendicularly upwardly from the body portion 88 and adapted to be journalled for rotation in the housing in a respective of the circular notches 56, a flat centrally open rectangular collar 90 extending at an angle from the pivot to form one end of the lever, and an end portion 94 extending axially from the pivot and terminating in a thumb pad 96 to form the other end of the lever. The collar and body portions 90 and 88 are generally in a common plane with the collar being adapted to fit about the actuator whereby first and second edges **90*a* and 90*b* are positioned to drive against respective first and second sides of the actuator depending on the direction in which the lever is pivoted and thereby move the actuator from and into on and off positions. The end portion 94 extends through and is vertically movable within the combined notch 52**.

The lever 84 includes a central body 89, a pivot pin 93, a collar 91 and an end portion 95 extending from the pivot 93 and terminating in a thumb pad 96. The collar 91 and body 89 are in parallel but offset planes. The central body portions 88 and 89 are in a common vertical plane and pivot within such plane, and the two collars 90 and 91 are adapted to be in offset planes whereby to compactly superpose one another and abut against the actuator body. The lever 84 is movable within the other of the combined notches 54.

When the levers 82 and 84 are assembled, the pivot pins 92 and 93 are journalled for rotation in the support journals 56 formed in the opposite housing walls, the two collars 90 and 91 fit about the actuator 80, and the lever actuating end portions pass through the vertical housing slots and extend away from the housing to the thumb pads.

Figures 3, 4:
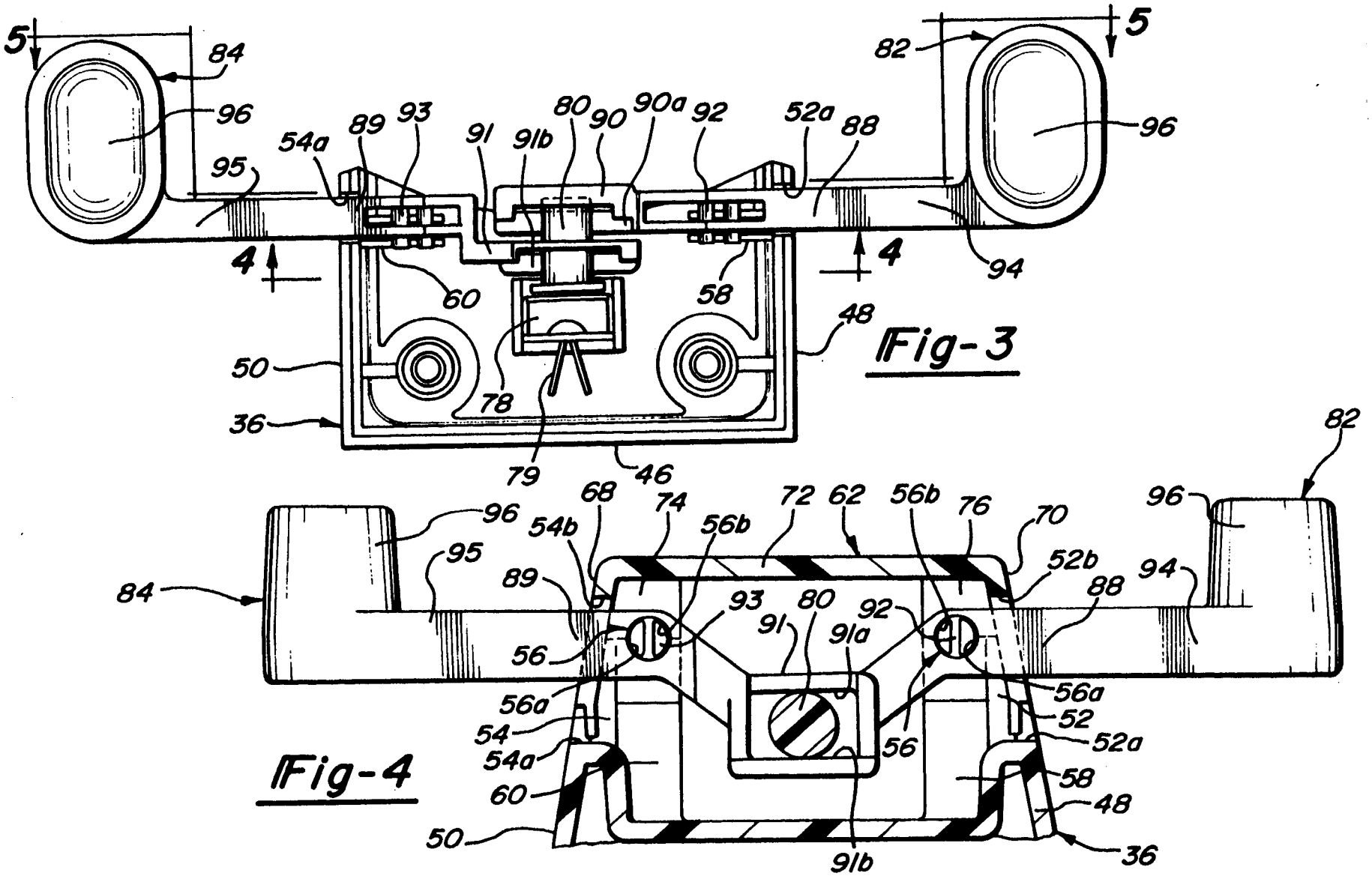
FIG. 3 is a plan view, through the control device a lower housing of FIG. 1, showing detail of the control device when disposed in a stable off position.
FIG. 4 is an elevation view, in section, taken along line 4—4 of FIG. 3 looking towards the polisher.

Initially, as shown best in FIGS. 3 and 4, the actuator is in the stable inoperative off position. When at least one of the thumb pads 96 is squeezed, such as the thumb pad on the lever 82, a force is transmitted to the collar 90 formed with the lever and one of its edges 90a or 90b is forced against the actuator 80. Since the two collars 90 and 91 are interconnected with the actuator, a force on the lever 82 is transmitted by the actuator via the collar 91 to the lever 84. A force on either or both of the thumb pads will operate to force the actuator in a first direction and from the inoperative first position to an operative second position. One of the operative second positions is a stable on and the other is a momentary on.

Figure 5:
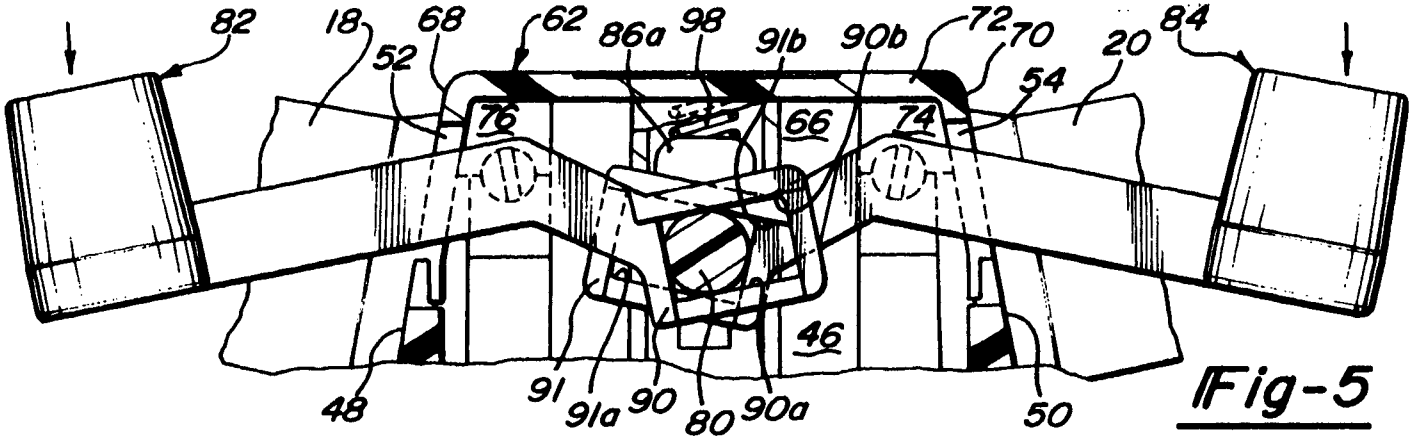
FIG. 5 is an elevation view, in section, taken along line 5—5 of FIG. 3 looking outwardly from the polisher and showing the control device disposed in a "momentary" on position.

Referring to FIG. 5, when the levers 82 or 84 are forced vertically downwardly, the actuator moves vertically upwardly to a momentary on position. When the actuator is in the momentary on position, release of the operator's hands will result in the switch spring automatically forcing the actuator back into the stable off position.

Figure 6:
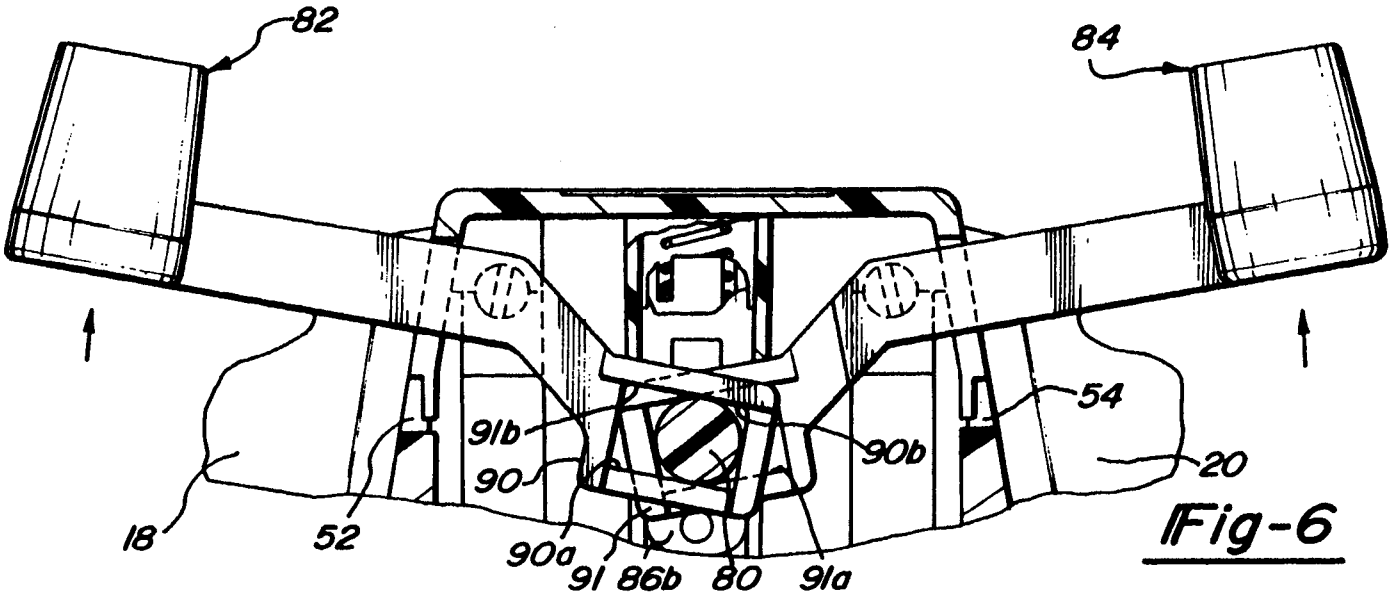
FIG. 6 is an elevation view, similar to FIG. 5, showing the control device disposed in a stable on position.

Referring to FIG. 6, when the levers 82 or 84 are forced vertically upwardly, the actuator is moved vertically downwardly and retained by the switch detent in a stable on position. In the stable on position, the operator must force the levers vertically downwardly and return the actuator to the stable off position.

In some situations, additional force assistance may be desired. As shown in FIG. 5, a vertically directed coil spring 98 is disposed between the front wall 66 and the switch 78 such that the opposite axial ends of the spring act against the top wall 72 and the actuator 80. The spring 98 acts to help force the actuator from the momentary on position back into the inoperative position.

Additionally, while the pivot pins 92 and 93 are shown integral with the levers 82 and 84, these pivots could be replaced by individual pivot pins that would extend through openings in the levers and mounted in the supports 56.

Figure 7:
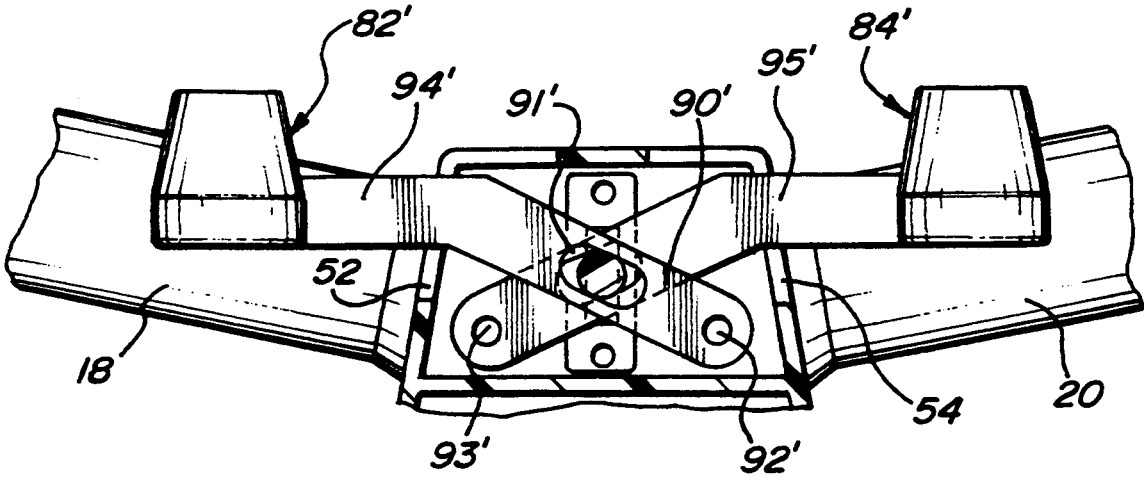
FIG. 7 is a plan view showing a modified arrangement of a three-position electrical control device according to the present invention and when in its stable off position.

In an alternate embodiment, as shown in FIG. 7, a pair of levers 82' and 84' are configured such that their pivot pins 92' and 93' are formed at one end of each lever and positioned in the housing, rectangular collar portions 90' and 91' define the central portion of the levers, and the end portions 94' and 95' extend away from the housing to a thumb pad. In this situation, the levers cross one another whereby the pivot pin 92' of the lever 82' is adjacent the housing wall having the notch 56 for receiving the lever 84', and the pivot pin 93' of the lever 84' is adjacent the housing wall having the notch 52 for receiving the lever 82'. Again, a force against either or both of the levers 82' and 84' will be transmitted directly against the actuator 80 whereby to force the actuator from an inoperative position and into first and second functions (e.g., two operative positions).

While the above description constitutes the preferred embodiment of the invention, it will be appreciated that the invention is susceptible to modification, variation, and change without departing from the proper scope or fair meaning of the accompanying claims.

What is claimed is:

1. An electrical control device for an electrical tool, said device comprising:

a housing;

electrical switch means connected to said housing for controlling said tool, said electrical switch means including a projecting actuator having opposite first and second sides and manually movable into either of two "on" positions and a stable "off" position; and actuating means, including at least one pair of elongated levers, for selectively moving said actuator between said "on" and "off" positions, each of said levers being mounted to pivot around a respective axis relative to said housing and having, respectively, a manually actuatable first end portion which extends transversely from its pivot axis, and a collar portion which is connected to said actuator and is movable against each of said first and second sides of said projecting actuator, each of said levers and said actuator moving conjointly.

2. The electrical control device as claimed in claim 1 wherein each said lever is generally planar and includes a body portion and a pivot pin projecting upwardly from said body portion, the body portion and the first end portion extending transversely in opposite directions from the pivot pin.

3. The electrical control device as claimed in claim 1 wherein each said lever is generally planar and includes a body portion and a pivot pin projecting upwardly from said body portion, said collar portion being disposed intermediate to the first end and the pivot pin.

4. The electrical control device as claimed in claim 1 further including a pivot pin connected to each said lever; and support means, disposed within said housing, for supporting said pivot pins and positioning said collar portions in superposed relation about said actuator.

5. (Amended) The electrical control device as claimed in claim 1 further comprising biasing means operating between said housing and said actuator, for biasing said actuator from the other of said "on" positions towards said "off" position.

6. A hand-held orbital polisher comprising a housing having a pair of hand engageable handles close-coupled thereto whereby the operator grasps the polisher closely adjacent to the housing and moves the polisher to desired regions of a surface to be polished, and an electric motor mounted in said housing; the improvement comprising an electrical control device for controlling the application of power to the motor comprising:

electric switch means mounted to said housing and in electrical circuit relation with said motor, said switch means having an actuator projecting therefrom and movable by linear sliding movement into an inoperable off position and into first and second operative on positions, actuator means, including a pair of elongated actuator levers, for moving said actuator and operating said motor, each said lever including first and second end portions, said first end portion forming an enlarged actuator pad spaced from the housing to receive an operator's finger; means for connecting the lever to the actuator; and pivot means for pivotably connecting said levers to said housing, said actuator pads being actuatable by respective fingers of the operator's left and right handle conjointly with the actuator to move the actuator without removing the grasp on the handles.

7. The orbital polisher as claimed in claim 6 wherein said connecting means includes each said lever having first and second edge portions to engage opposite sides of the actuator.

8. The orbital polisher as claimed in claim 7 wherein said connecting means comprises each said second end portion defining a respective collar to receive said actuator and simultaneously drive its respective first and second edge portions against first and second sides of the actuator, and said pivot means includes a pivot pin disposed between the first and second end portions of the levers, each said pivot pin mounted to said housing.

9. The orbital polisher as claimed in claim 8 wherein said pivot pins are integral with the levers.

10. The orbital polisher as claimed in claim 7 wherein said connecting means includes a collar defined between said first and second end portions, and said pivot means includes a pivot pin disposed at each said second end portion and mounted to said housing, each collar includes the respective first and second edges to drive against first and second sides of the actuator.

11. The orbital polisher as claimed in claim 10 wherein said pivot pins are integral with the levers.

12. The orbital polisher as claimed in claim 6 wherein said connecting means comprises each said lever including a generally rectangular centrally open frame sized to fit about the actuator with opposite respective edges of the frame being adapted to engage opposite sides of the actuator, and said pivot means mounting the levers for movement in a common vertical plane and the frames in stacked superposed relation.

13. A hand-held orbital polisher, comprising a vertical housing having left and right handles and an open bottom portion for positioning a polishing pad and, an electrical motor carried by said housing and having a vertically disposed output shaft extending to said bottom portion; the improvement comprising a control device for controlling said motor, said device including a control box adjacent a respective end portion of each handle and having laterally spaced and vertically slotted first and second sidewalls, a switch operably associated with the electrical circuit of the motor and having a linearly movable actuator, means for mounting the switch in said housing and between the sidewalls thereof such that the switch actuator is disposed for vertical movement, and first and second elongated levers mounted to pivot in said box about a respective axis with each lever extending through the slot in a respective one of said first and second sidewalls and having a manually actuatable first end portion spaced from the housing and a second opposite end portion adapted for vertical driving engagement with the actuator, said levers being interconnected with one another via the actuator such that vertical movement of at least one lever is substantially simultaneously transmitted to and causes corresponding movement of the other lever.

14. The orbital polisher as claimed in claim 13 wherein said control box includes upper and lower housing sections which join to form a closure, one of said housing sections being joined to said handles; a pivot pin connected to each said lever; and means operating between the housing sections for defining a first and second journal for supporting a respective pivot pin.

15. The orbital polisher as claimed in claim 14 wherein the second end portion of each said lever comprises a centrally open rectangular collar, said collar including first and second edges for drivingly engaging the actuator, and each said lever includes a body portion extending between the collar portion and the first end portion, said pivot pin being integrally formed to said body portion.

16. The orbital polisher as claimed in claim 15 wherein said levers define a first and a second pivot pin, said first and second pivot pins being adjacent the respective first and second sidewalls of the control box, and said collar portions being centrally disposed and between said sidewalls.

17. The orbital polisher as claimed in claim 14 wherein the second end portion of each said lever comprises a centrally open rectangular collar, said collar including first and second edges for drivingly engaging the actuator, and each said lever includes a body portion extending from the collar portion, said pivot pin being integrally formed to said body portion.

18. The orbital polisher as claimed in claim 17 wherein said first and second pivot pins are located, respectively, adjacent to the second and first sidewalls of the control box, and said collar portions are centrally disposed and between said sidewalls.

19. A method of controlling startup of an electrically powered surface treatment machine of the type including a switch operated electric motor for driving a surface treating element and a pair of hand levers that are actuable by an operator to actuate the switch and thereby operate the motor, comprising the steps, each beginning in an inoperative first position with the operator using one hand to grasp the machine and neither hand lever being actuated, of sequentially causing energization and deenergization of the electric motor either (i) upon at least one of said levers being actuated and thereby simultaneously moving both levers, respectively, in a first direction to an operable second position and in a second direction from said second position to said inoperable first position, said levers being retained in said second position upon release of said hand and returned to said first position by at least one of said levers being actuated; and (ii) upon at least one of said levers being actuated and thereby simultaneously moving both levers, respectively, in said second direction to an operable second position, said levers being maintained in said second position only by said hand and release of said hand permitting each of said hand levers to be moved back to the inoperative first position to prevent energization of the electric motor.

20. A method as claimed in claim 19, including the step, following energization of the electric motor upon both hand levers being simultaneously moved from said first position in said second direction, and maintaining the electric motor energized for as long as at least one hand lever is actuated.

21. A method as claimed in claim 20, including the step, following said step of enabling simultaneous movement of both hand levers from their deactuated to their actuated positions, of maintaining the electric motor energized for as long as at least one hand lever is moved to its actuated position.

22. An electrical control device for an electrical tool, said device comprising:

a housing;

electrical switch means connected to said housing for controlling said tool, said electrical switch means including an actuator having opposite first and second sides and manually movable into either of two "on" positions and a stable "off" position, a pair of elongated levers each mounted to pivot around a respective axis relative to said housing for selectively moving said actuator between said "on" and "off" positions, each of said levers having a drive end and a driven end;

connecting means, including a pivot pin between opposite ends of each lever, for connecting the levers to the housing; and collar means, connected to each of said driven ends and movable against the first and second sides of said projecting actuator, for transmitting force applied to the drive end of at least one lever to the other lever and conjointly moving said levers and said actuator upon application of said force.

* * * * *